United States Patent [19]

Noice

[11] 4,096,978

[45] Jun. 27, 1978

[54] BACKPACK

[75] Inventor: Frank M. Noice, Big Fork, Mont.

[73] Assignee: Maran Corporation, Big Fork, Mont.

[21] Appl. No.: 712,741

[22] Filed: Aug. 9, 1976

[51] Int. Cl.[2] ..... A45F 3/00

[52] U.S. Cl. ..... 224/8 R; 150/1; 190/44; 190/51

[58] Field of Search ..... 224/8 R, 8 A, 9, 10, 224/11, 12, 25 A, 5 H, 5 W, 6, 32 R, 32 A, 34, 35, 36, , 43, 44, 47; 190/44, 51; 150/1, 3, 2.7, 28 R, 30

[56] References Cited

U.S. PATENT DOCUMENTS

| | | | |
|---|---|---|---|
| 362,302 | 5/1887 | Merriam | 224/11 |
| 518,270 | 4/1894 | Orth | 224/8 R |
| 2,456,247 | 12/1948 | Bernau | 224/8 R |
| 2,737,221 | 3/1956 | Knox | 150/28 R X |
| 3,292,747 | 12/1966 | Dawson | 190/44 X |
| 3,726,329 | 4/1973 | Dean | 190/44 X |
| 3,973,609 | 8/1976 | Lofberg | 150/1 |

FOREIGN PATENT DOCUMENTS

| | | | |
|---|---|---|---|
| 943,924 | 3/1974 | Canada | 224/8 R |
| 26,352 | 12/1953 | Finland | 224/8 R |
| 974,498 | 2/1951 | France | 190/44 |
| 631,413 | 6/1936 | Germany | 224/8 R |
| 75,869 | 10/1949 | Norway | 224/8 R |
| 870,215 | 6/1961 | United Kingdom | 224/8 R |

*Primary Examiner*—Trygve M. Blix
*Assistant Examiner*—Winston H. Douglas
*Attorney, Agent, or Firm*—David L. Garrison

[57] ABSTRACT

Disclosed is a backpack comprised of a flexible bag for containing a load to be carried and adjustable-length connection means extending across the interior of the bag and interconnecting the front and rear thereof. The volume of the bag can be adjusted to match variously-sized loads by adjusting the lengths of the connection means.

16 Claims, 6 Drawing Figures

Fig. 1.
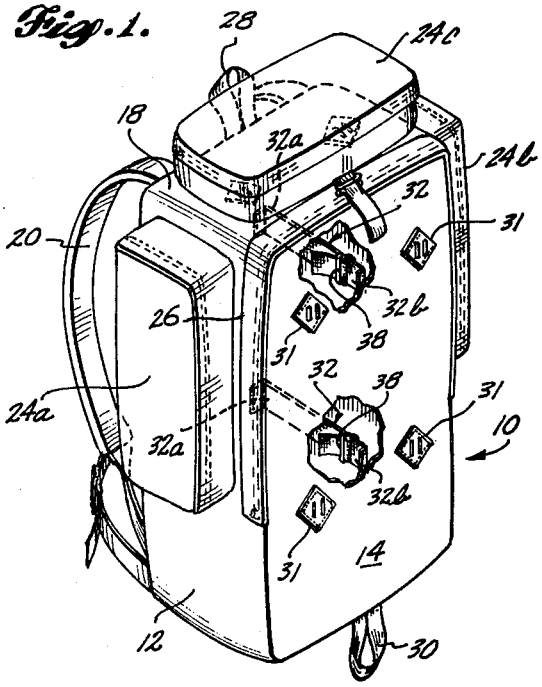
Fig. 2
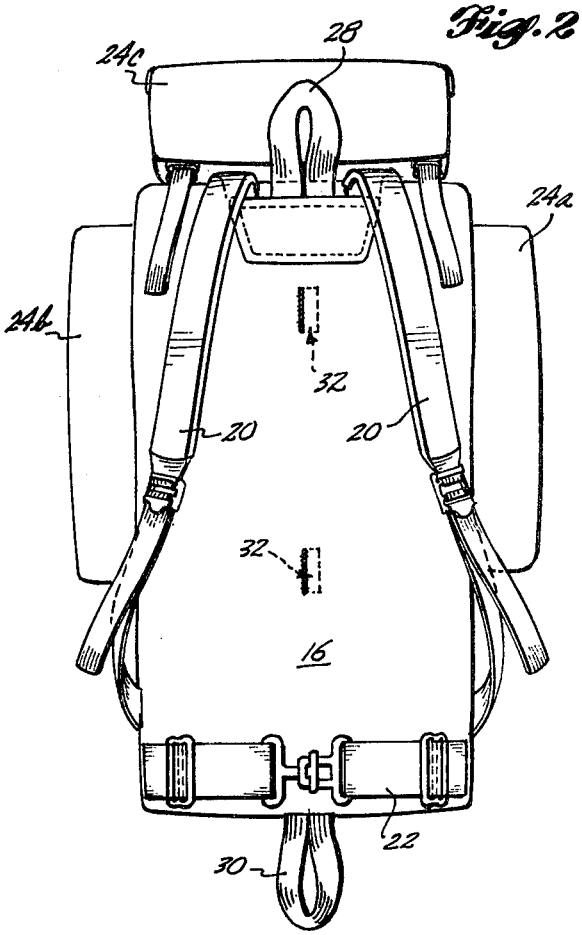
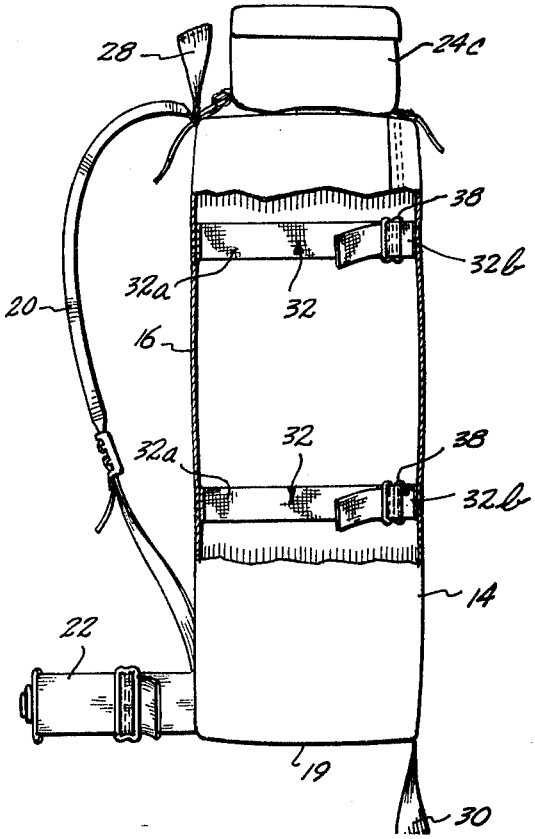
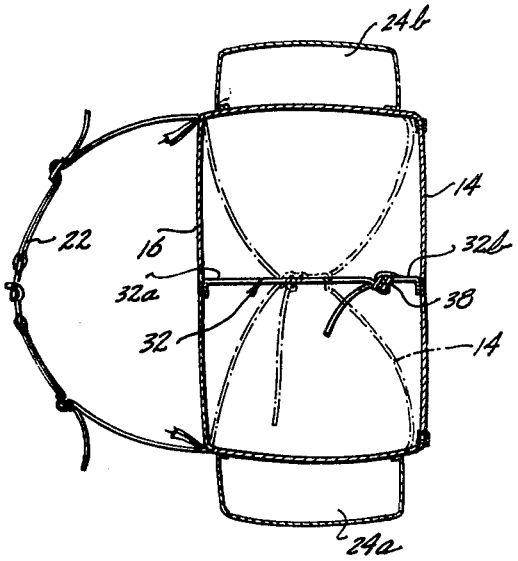
Fig. 4.

BACKPACK

BACKGROUND OF THE INVENTION

This invention relates to backpacks and more particularly to those comprised of a flexible bag for containing a load to be packed.

It is generally recognized that backpacks are easiest to carry when the center of gravity of the load is located approximately midway between the shoulders and waist of the packer. One difficulty encountered during use of conventional backpacks is that a load contained in the pack frequently settles as the pack is agitated while being carried. This lowers the center of gravity of the pack, making it more difficult to bear. Similarly, when such a backpack is loaded to substantially less than its capacity, its center of gravity will be low, even if significant settling does not occur.

It is an object of this invention to provide a backpack including a flexible bag which can be reduced in volume in comparison to its volume when fully expanded so that the bag is pressed against a full load to reduce settling thereof or is reduced in volume in comparison to its fully expanded volume so that a load which would only partially fill the fully expanded bag, substantially fills the reduced volume of the bag.

SUMMARY OF THE INVENTION

In summary, this invention is directed to an improvement in backpacks of the type including a flexible bag for containing a load to be packed and shoulder straps normally extending forwardly of the front of the bag. The improvement comprises adjustable-length connection means or adjustment means extending across the interior of the bag and interconnecting the front and rear thereof such that the effective volume of the bag can be varied by adjusting the length of said connection means. Preferably, the adjustable-length connection means interconnects the front and back of the bag approximately midway between the sides thereof. The connection or adjustment means can be, for example, a single strap, a pair of vertically spaced-apart straps or a laced cord, associated with partial or complete septa, extending between the interior surfaces of the front and back of the bag. Alternatively, the connection or adjustment means can be one or more cords, each of which extends from the front or back of the bag through a hole in the opposing front or back of the bag such that the cord is accessible from the exterior of the bag.

BRIEF DESCRIPTION OF THE DRAWINGS

FIGS. 1 and 2 are, respectively, an isometric view and a front view of a backpack in accordance with the present invention.

FIG. 3 is a side view of the backpack of FIGS. 1 and 2 with a side of the bag thereof partially removed to show the adjustment means in the form of straps extending across the interior of the bag.

FIG. 4 is a cross-sectional view taken along line 4—4 of FIG. 2.

DETAILED DESCRIPTION OF THE INVENTION

Figure 5:
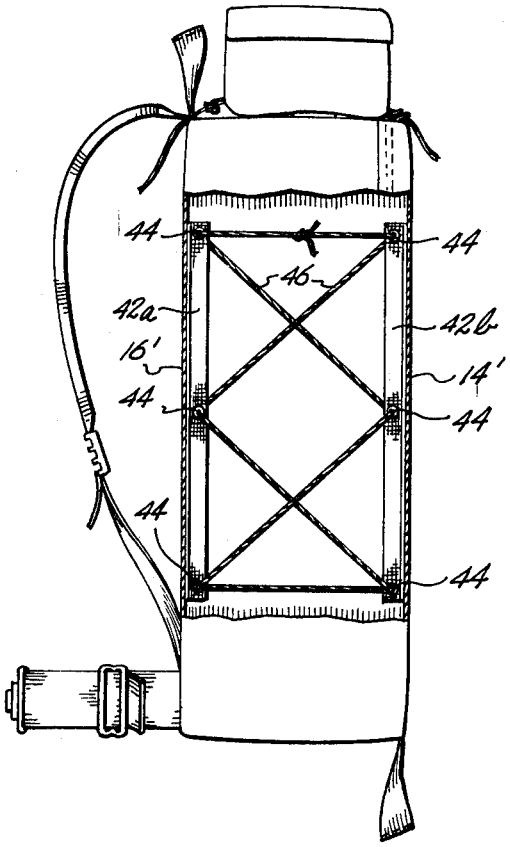
FIG. 5 is a simplified side elevation view of a backpack in accordance with the present invention with the near side of the bag thereof removed to show the adjustable-length connection means extending from partial septa across the interior thereof.

Referring to FIGS. 1–4, there is shown a backpack 10 in accordance with this invention comprising a flexible cloth bag for containing the major portion of a load to be packed. A pair of shoulder straps 20 and a waist belt 22 are connected to the front 16 of the bag and extend forwardly therefrom. The shoulder straps are each connected at the upper end thereof to the front of the backpack near its top and at the lower end thereof adjustably to the backpack near the bottom thereof as shown.

Secured to the sides 12 and top 18 of the bag are three small zippered compartments **24*a*, 24*b* and 24*c* useful for carrying small items of various sorts. A looped strap 28, by which the pack can be hung up when not being worn, is secured at the top of the front of the bag and a second looped strap 30, in which a tool such as an ice axe, fishing pole or the like can be secured, is positioned at the juncture of the back and bottom of the bag. Exterior tie-down patches 31** are provided for securing gear to the back of the pack with straps (not shown).

The sides 12 and back 14 of the bag are formed into a closed tubular shape having an opening in the upper portion of the back 14. A zipper 26, which may be opened from either end, extends around the sides and top of the opening.

In one embodiment of this invention, (shown best in FIGS. 3 and 4) the adjustable-length connection means or adjustment means comprises two straps **32*a* and 32*b* extending across the interior of the bag and interconnecting the front 16 and back 14 thereof. The straps 32*a* and 32*b* are spaced from the sides 12, top 18 and bottom 19 of the bag and are spaced apart from one another. Each strap is comprised of a first length of flexible nylon webbing 32*a* sewn at one end to the front 16 of the bag and a second, shorter length of nylon webbing 32*b* sewn at both ends to the back 14 of the bag to form a loop which passes through two metal rings 38. The free end of the first length of webbing 32*a* extends through the two rings 38 and is looped back through one of them in a manner that causes the rings 38 to clamp the first length 32*a*** when the strap is under tension and that allows the first length to slide through the rings when tension is released or when the free end of the first length is pulled.

In another embodiment, a buckle may be substituted for the two rings 38 to adjustably secure the webbing at the desired location along its length, thereby defining the distance between the front and back of the pack.

When the load to be carried substantially fills the bag to its capacity, the straps 32 can be tightened to compress the front 16 and back 14 of the bag tightly against the full load so as to minimize settling as the backpack 10 is agitated while being carried. When the load to be carried would only partially fill the bag if expanded to its maximum volume, the user can reduce the volume of the bag to substantially match that of the partial load by shortening the straps 32 to draw the front 16 and back 14 of the bag together. With the volume of the bag thus matched to the volume of the partial load, the center of gravity of the load will be positioned higher than it would be if the effective volume of the bag were not reduced. FIG. 4 shows, in dotted lines, contraction of the bag from its substantially fully expanded volume to a volume matching that of a partial load contained therein. It can be seen that when the straps are tightly drawn against a load in the pack, the pack assumes a dimpled shape.

Figure 6:
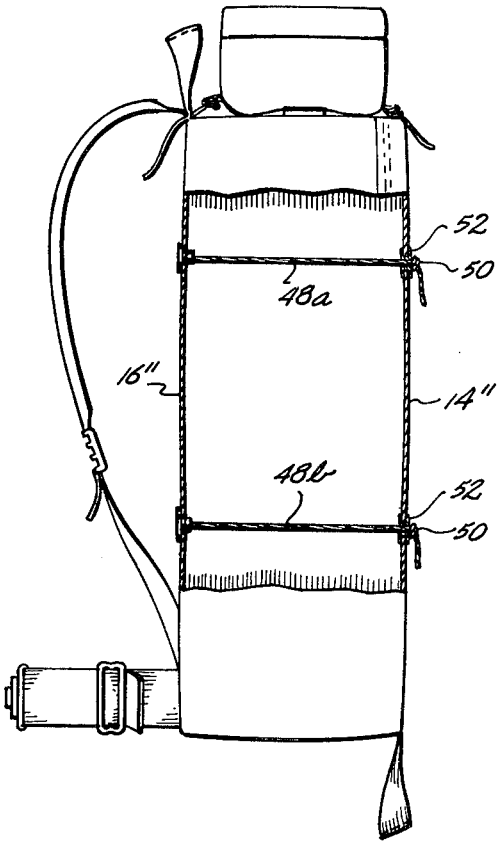
FIG. 6 is a simplified side elevation view of a backpack in accordance with the present invention with the near side of the bag thereof removed to show the adjustable-length connection means extending from the front through the back of the pack.

The embodiments of FIGS. 5 and 6 are identical to that of FIGS. 1–4 except for the adjustable-length means interconnecting the front and back of the bags. In FIG. 5, the adjustable-length connection means, comprising first and second vertically extending, partial septa 42*a* and 42*b* (comprising strips of fabric, flexible nylon webbing, or other suitable material), are sewn along their length to the front 16' and back 14' of the bag, respectively, approximately midway between the sides thereof. The partial septa 42*a* and 42*b* include eyelets 44 spaced-apart along their lengths and are interconnected by a lacing means 46 passing through the eyelets 44. By varying the tightness of the lacing means 46 (i.e., the length of the connection means), the spacing between the partial septa and hence the spacing between the front 16' and back 14' of the bag can be varied. The embodiment of FIG. 5 further includes a partial compartmentalization of the interior of the backpack 10 by the septa 42*a* and 42*b* and the lacing means 46 extending therebetween. Alternatively, the septa may extend completely across the bag interior to provide an interior wall substantially dividing the bag, which wall is adjustable in width by varying the tightness of the lacing means.

Referring now to the embodiment of FIG. 6, the front 16" and back 14" of the bag are interconnected by two vertically spaced-apart cords 48*a* and 48*b* extending across the interior of the bag approximately midway between the sides thereof. One end of each cord 48*a* and 48*b* is firmly attached to the front 16" of the bag and the other end passes through a hole 50 in one of two leather eyelets 52 sewn onto the back 14" of the bag. The front 16" and back 14" of the bag can be drawn together simply by pulling on the free ends of the cords 48*a* and 48*b* and forming knots 54 (which will not pass through the eyelets) in the cords at locations which will maintain the desired separation between the front 16" and back 14" of the bag.

The backpack shown herein provides adjustable-length connection means by varying the interior volume of the flexible bag by drawing a portion of the front of the pack toward a portion of the back of the pack. Thus the bag can be reduced in volume in comparison to its fully expanded volume so that a load which would only partially fill the fully expanded bag, substantially fills the reduced volume of the bag.

One variation of this invention provides interior separation or compartmentalization of the backpack while permitting free access to the interior and goods stowed therein. Another embodiment provides exterior access to the adjustable-length connection means, eliminating the necessity of opening the pack to adjust the load. Thus, convenience and usability of the pack is enhanced for loads of varying bulk and weight.

Other modifications and forms, such as further variations in the adjustable-length connection means and varying closure means will be apparent to one of ordinary skill in the art and are intended to be included within the scope of this invention.

I claim:

1. In a back pack including a flexible bag comprising a front, a back, sides, a top and a bottom, for containing a load to be packed and shoulder straps attached to and extending forwardly from the front of the bag, the improvement comprising means to adjust the interior volume of said flexible bag including an adjustable length connection means extending across the interior of the bag and interconnecting the front and rear thereof at locations spaced inwardly from the sides, the top, and the bottom such that the effective interior volume of said bag can be varied by adjusting the length of said connection means thereby drawing said locations on said front and said back together.

2. The backpack of claim 1 wherein the connection means interconnects the front and rear of the bag approximately midway between the sides of the bag.

3. The backpack of claim 2 wherein the connection means comprises at least one strap.

4. The backpack of claim 2 wherein the connection means comprises a pair of vertically spaced-apart straps.

5. The backpack of claim 2 wherein the connection means comprises a cord and the back of the bag defines a hole through which the cord extends such that said cord is accessible from the exterior of the bag.

6. The backpack of claim 2 wherein the connection means comprises a pair of vertically spaced-apart cords and the back of the bag defines a pair of vertically spaced-apart holes, each of said cords ending through one of the holes such that it is accessible from the exterior of the pack.

7. The backpack of claim 1 wherein the connection means comprises a strap.

8. The backpack of claim 1 wherein the connection means comprises a pair of vertically spaced-apart straps.

9. The backpack of claim 1 wherein the connection means comprises a cord and the back of the bag defines a hole through which the cord extends such that said cord is accessible from the exterior of the bag.

10. The backpack of claim 1 wherein the connection means comprises a pair of vertically spaced-apart cords and the back of the bag defines a pair of vertically spaced-apart holes, each of said cords ending through one of the holes such that it is accessible from the exterior of the pack.

11. The backpack of claim 1 wherein said connection means comprises adjustable lacing means extending between front and back septa, said front and back septa being securely fastened to the front and back of said backpack, respectively, whereby adjustment of the length of said lacing means varies the distance between said front and back panels said connection means functioning as an interior wall substantially dividing the interior of said backpack into two compartments.

12. A backpack for accommodating variously sized loads by varying the interior volume of said backpack comprising a flexible bag having a front, a back, sides, a top and a bottom;

shoulder straps attached to said bag, the upper end of each of said straps being fixed to the upper portion of said front and the lower end of each of said straps being adjustably attached to said bag near the bottom thereof; and adjustment means disposed within the bag extending across the inside of the bag between said front and said back and attached thereto at mounting locations positioned approximately midway between the sides and inwardly from the top and the bottom of the bag, said adjustment means being adjustable in length to vary the distance between the front and back of the pack at said mounting locations, whereby the front and back of said pack can be drawn tightly against a partial load in the pack.

13. The apparatus of claim 12 wherein said adjustment means functions as an interior wall dividing said backpack into two interior compartments.

14. The apparatus of claim 12 wherein said adjustment means comprises a cord means laced across the interior of said backpack.

15. The apparatus of claim 12 wherein said adjustment means comprises at least one strap sewn to said front and to said back at approximately midway between said sides, said straps being adjustably connectable at varying lengths to define the distance between said front and back.

16. The apparatus of claim 12 wherein said adjustment means functions as an interior divider separating the interior of said backpack into two compartments.

* * * * *